US005638845A

United States Patent [19]

Oliver et al.

[11] Patent Number: 5,638,845

[45] Date of Patent: Jun. 17, 1997

[54] SCISSOR JET CLEANING DEVICE

[76] Inventors: Michael A. Oliver, 12643 Potter Tract Rd., Grand Bay, Ala. 36605; John W. Mincy, P.O. Box 81692, Mobile, Ala. 36608

[21] Appl. No.: 555,165

[22] Filed: Nov. 8, 1995

[51] Int. Cl.[6] ..... B08B 3/02; B08B 9/093

[52] U.S. Cl. ..... 134/167 R; 239/227; 239/265

[58] Field of Search ..... 134/167 R, 168 R; 118/306, 317; 239/227, 261, 265

[56] References Cited

U.S. PATENT DOCUMENTS

| | | | |
|---|---|---|---|
| 4,163,455 | 8/1979 | Hebert et al. | 134/167 R |
| 4,428,985 | 1/1984 | Bertolazzi | 118/306 X |
| 5,107,879 | 4/1992 | Harvey | 134/167 R |
| 5,352,298 | 10/1994 | Moulder | 134/168 R X |
| 5,392,798 | 2/1995 | Hirose et al. | 134/167 R |
| 5,518,553 | 5/1996 | Moulder | 134/167 R X |

*Primary Examiner*—Philip R. Coe
*Attorney, Agent, or Firm*—Michael I. Kroll

[57] ABSTRACT

A scissor jet cleaning device (10) for cleaning the interior of a tank (12) through a dome (14) on the tank (12) of a tanker (16). The device (10) comprises a support arm (18) that is adjustable in length. An assembly (20) is mounted to the dome (14) and is connected to a first side of the support arm (18), for extending and retracting the support arm (18) within the tank (12). A double spray nozzle head (22) is mounted in a rotatable manner to a second side of the support arm (18). A facility (24) is for fluidly connecting the double spray nozzle head (22) to pressurized cleaning fluid, so as to clean the interior of the tank (12). A structure (26) is connected to the extending and retracting assembly (20), for rotating the support arm (18) in its retracted position 180 degrees, so that the double spray nozzle head (22) can clean the interior of the tank (12) in an opposite direction.

19 Claims, 3 Drawing Sheets

SCISSOR JET CLEANING DEVICE

BACKGROUND OF THE INVENTION

1. Field of the Invention

The instant invention relates generally to spray wash apparatuses and more specifically it relates to a scissor jet cleaning device.

2. Description of the Prior Art

Numerous spray wash apparatuses have been provided in prior art that are adapted to remove dirt and grime from various articles with water pressure. While these units may be suitable for the particular purpose to which they address, they would not be as suitable for the purposes of the present invention as heretofore described.

SUMMARY OF THE INVENTION

A primary object of the present invention is to provide a scissor jet cleaning device that will overcome the shortcomings of the prior art devices.

Another object is to provide a scissor jet cleaning device that allows safe cleaning, using any cleaning agent or combination of cleaning agents and abrasives, while using a liquid at high pressure or high volume or combination of both to clean tank interiors.

An additional object is to provide a scissor jet cleaning device that operates in the tank interiors of all types of rail cars and transport tankers, so that the entry of a person through the domes to clean the tanks is eliminated.

A further object is to provide a scissor jet cleaning device that is simple and easy to use.

A still further object is to provide a scissor jet cleaning device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
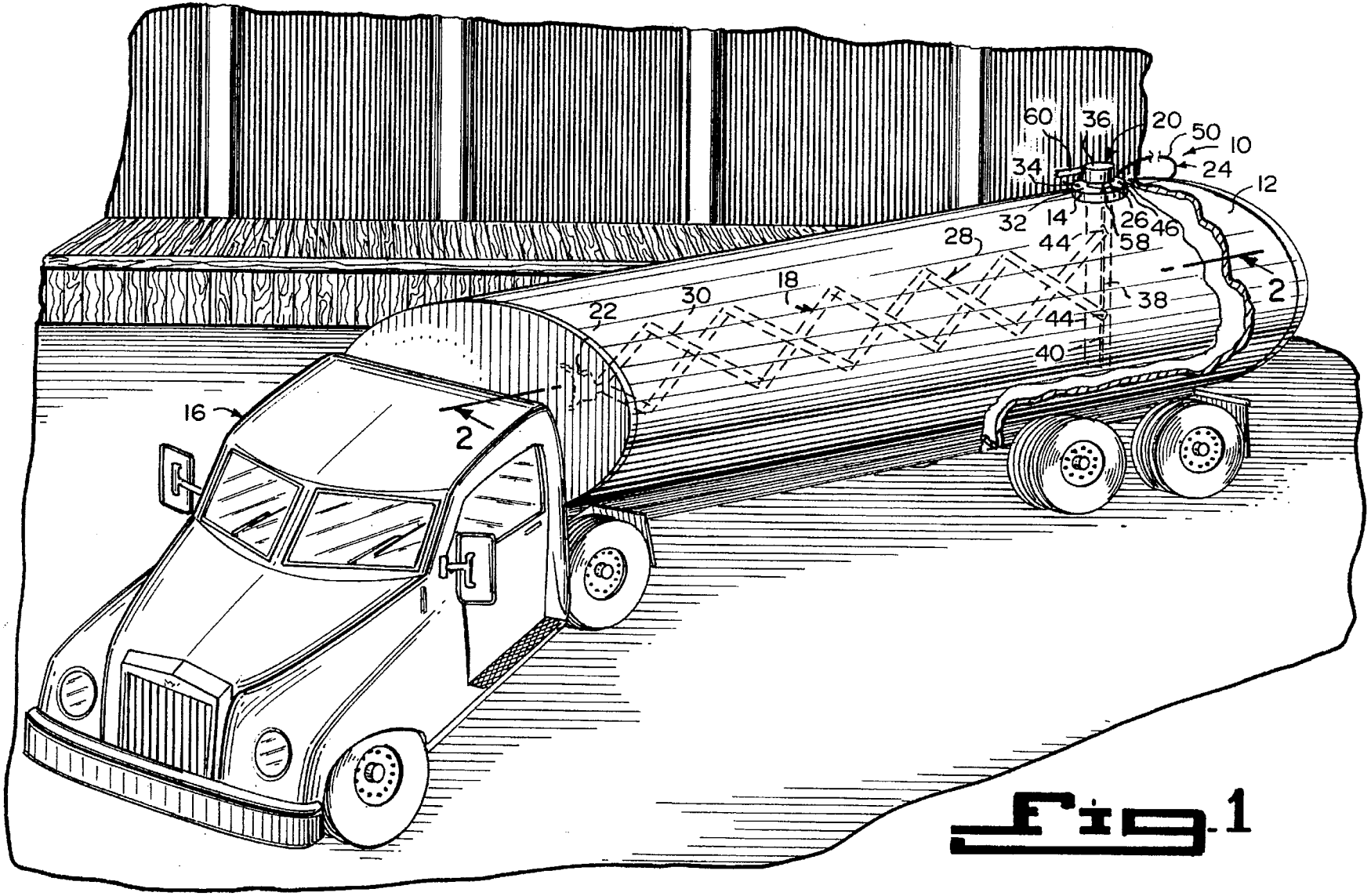
FIG. 1 is a perspective view with parts broken away, showing the instant invention installed within a tanker truck.
Figure 2:
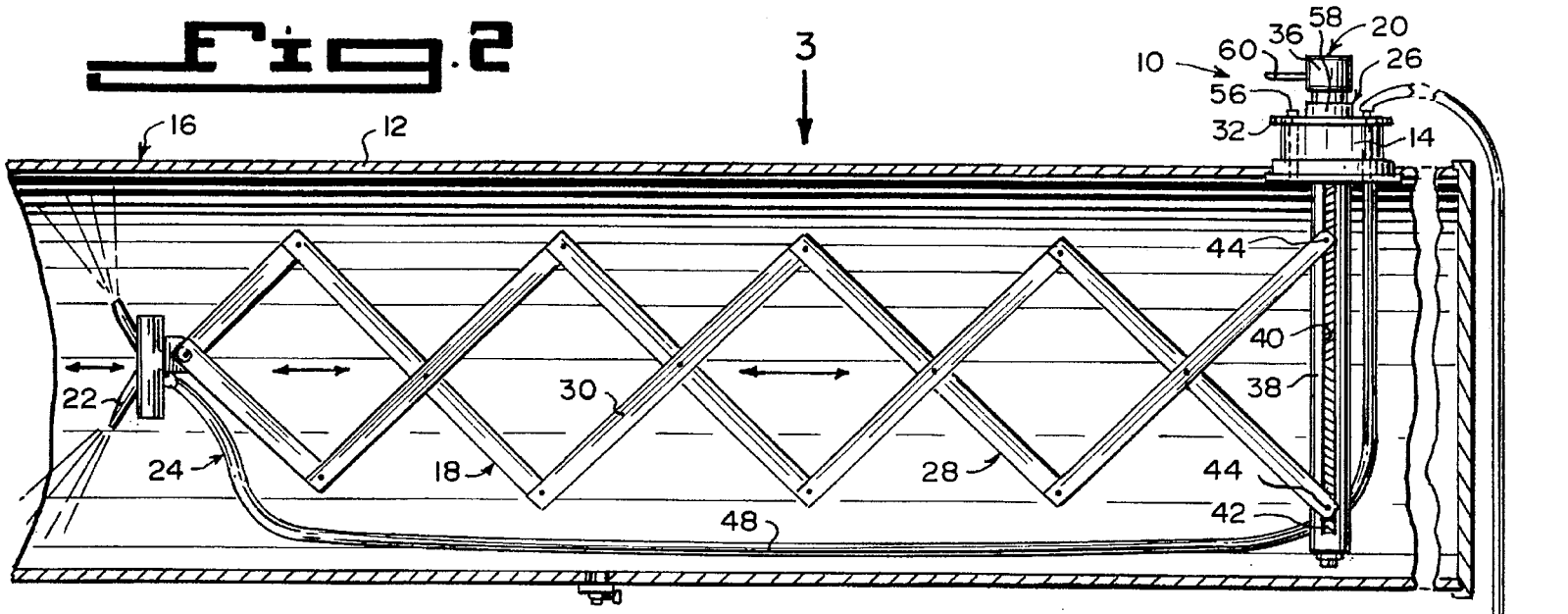
FIG. 2 is a cross sectional view taken along line 2—2 in FIG. 1.

Turning now descriptively to the drawings, in which similar reference characters denote similar elements throughout the several views, FIGS. 1 through 5 illustrate a scissor jet cleaning device 10 for cleaning the interior of a tank 12 through a dome 14 on the tank 12 of a tanker 16. The device 10 comprises a support arm 18 that is adjustable in length. An assembly 20 is mounted to the dome 14 and is connected to a first side of the support arm 18, for extending and retracting the support arm 18 within the tank 12.

A double spray nozzle head 22 is mounted in a rotatable manner to a second side of the support arm 18. A facility 24 is for fluidly connecting the double spray nozzle head 22 to pressurized cleaning fluid, so as to clean the interior of the tank 12. A structure 26 is connected to the extending and retracting assembly 20, for rotating the support arm 18 in its retracted position 180 degrees, so that the double spray nozzle head 22 can clean the interior of the tank 12 in an opposite direction.

The support arm 18 is a lazy tongs configuration 28. The lazy tongs configuration 28 includes a plurality of jointed extendable bars 30 that are disposed between the extending and retracting assembly 20 and the double spray nozzle head 22.

The extending and retracting assembly 20 consists of a dome cover plate 32. Components 34 are for fastening the dome cover plate 32 to the dome 14 of the tank 12. A reversible motor 36 is positioned over the dome cover plate 32. A cylindrical casing 38 is provided, having an elongated vertical slot 40. The cylindrical casing 38 is affixed to the reversible motor 36 and extends downwardly therefrom through the dome cover plate 32.

A left and right threaded worm drive shaft 42 extends downwardly in the cylindrical casing 38 and is driven by the reversible motor 36. A pair of followers 44 on the first side of the support arm 18 ride within the vertical slot 40 in the cylindrical casing 38. The followers 44 can be moved towards and away from each other, depending upon direction of rotation by the left and right threaded worm drive shaft 42 that engages with the followers 44. The fastening components 34 are a plurality of bolts 46, which are radially threaded into the dome cover plate 32 adjacent to and about the circumference of the dome cover plate 22 and then into the dome 14 of the tank 12.

The fluidly connecting facility 24 contains a first hose line 48 extending between the double spray nozzle head 22 and the dome cover plate 32. A second hose line 50 extends between the dome cover plate 32 and a faucet 52 on a container 54 holding the pressurized cleaning fluid therein. When the faucet 52 is opened, the pressurized cleaning fluid will flow out of the container 54 to the double spray nozzle head 22. A vent pipe 56 extends through the dome cover plate 32, so as to vent out air from the interior of the tank 12.

The rotating structure 26 includes a thrust bearing 58 mounted through the dome cover plate 32, to allow a top portion of the cylindrical casing 38 to rotate thereabout. A handle pointer 60 extends from one side of the reversible motor 36 in the same direction as the support arm 18 within the tank 12. A hand of a person can grip the handle pointer 60 and move the reversible motor 36, to properly position the support arm 18 within the tank 12.

Figure 3:
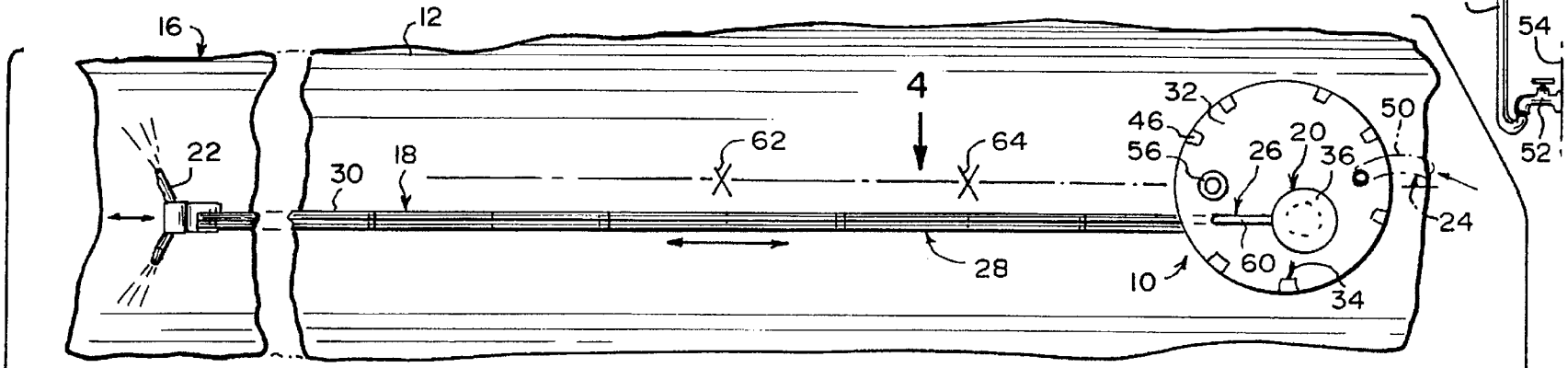
FIG. 3 is a diagrammatic top view with parts broken away, taken in the direction of arrow 3 in FIG. 2.
Figure 4:
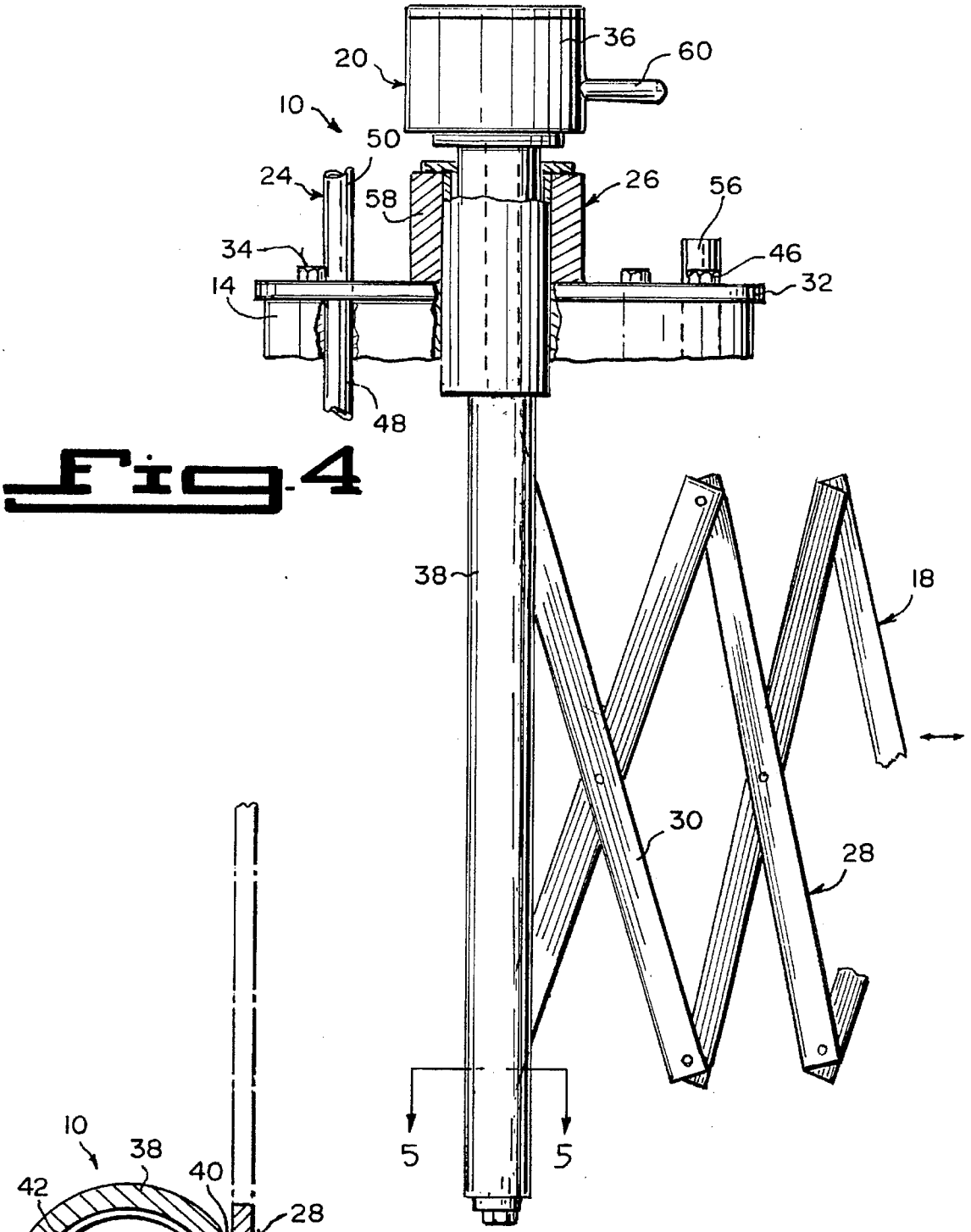
FIG. 4 is an enlarged elevational view with parts broken away and in section, taken in the direction of arrow 4 in FIG. 3.
Figure 5:
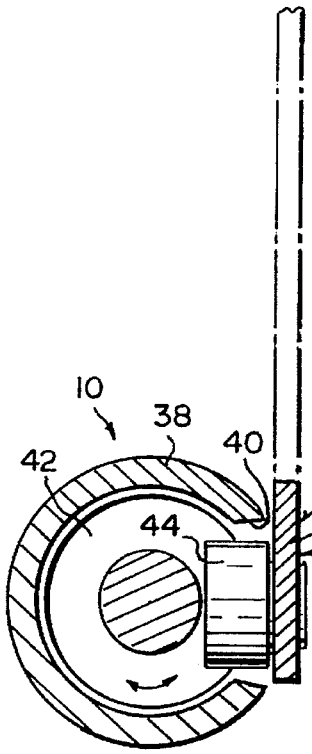
FIG. 5 is an enlarged cross sectional view taken along line 5—5 in FIG. 4.

The thrust bearing 58 is mounted offset from the center in the dome cover plate 32, to allow the support arm 18 to bypass a valve stem 62 and blow leg 64 inside the tank 12 of the tanker 16, shown diagramatically in FIG. 3. The reversible motor 36 could be a hydraulic operated type motor.

The reversible motor 36 could also be an electrical operated type motor. The tank 16 can be a transport tanker, as shown in FIG. 1. The tanker 16 can also be a rail car, not shown in the drawings.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A scissor jet cleaning device for cleaning the interior of a tank through a dome on the tank of a tanker, said device comprising:

a) a support arm that is adjustable in length;

b) means mounted to the dome and connected to a first side of said support arm, for extending and retracting said support arm within the tank;

c) a double spray nozzle head mounted in a rotatable manner to a second side of said support arm;

d) means for fluidly connecting said double spray nozzle head to pressurized cleaning fluid, so as to clean the interior of the tank; and e) means connected to said extending and retracting means, for rotating said support arm in its retracted position 180 degrees, so that said double spray nozzle head can clean the interior of the tank in all directions.

2. A scissor jet cleaning device as recited in claim 1, wherein said support arm is a lazy tongs configuration.

3. A scissor jet cleaning device as recited in claim 2, wherein said lazy tongs configuration includes a plurality of jointed extendable bars that are disposed between said extending and retracting means and said double spray nozzle head.

4. A scissor jet cleaning device as recited in claim 3, wherein said extending and retracting means includes:

a) a dome cover plate;

b) means for fastening said dome cover plate to the dome of the tank;

c) a reversible motor positioned over said dome cover plate;

d) a cylindrical casing having an elongated vertical slot, said cylindrical casing is affixed to said reversible motor and extends downwardly therefrom through said dome cover plate;

e) a left and right threaded worm drive shaft which extends downwardly in said cylindrical casing and driven by said reversible motor; and f) a pair of followers on the first side of said support arm that ride within the vertical slot in said cylindrical casing, said followers can be moved towards and away from each other depending upon direction of rotation by said left and right threaded worm drive shaft that engages with said followers.

5. A scissor jet cleaning device as recited in claim 4, wherein said fastening means includes a plurality of bolts which are radially threaded into said dome cover plate adjacent to and about the circumference of said dome cover plate and then into the dome of the tank.

6. A scissor jet cleaning device as recited in claim 5, wherein said fluidly connecting means includes:

a) a first hose line extending between said double spray nozzle head and said dome cover plate; and b) a second hose line extending between the dome cover plate and a faucet on a container holding the pressurized cleaning fluid therein, so that when the faucet is opened, the pressurized cleaning fluid will flow out of the container to said double spray nozzle head.

7. A scissor jet cleaning device as recited in claim 6, further including a vent pipe extending through said dome cover plate, so as to vent out air from the interior of the tank.

8. A scissor jet cleaning device as recited in claim 7, wherein said rotating means includes:

a) a thrust bearing mounted through said dome cover plate, to allow a top portion of said cylindrical casing to rotate thereabout; and b) a handle pointer extending from one side of said reversible motor in the same direction as said support arm within the tank, so that a hand of a person can grip said handle pointer and move said reversible motor to properly position said support arm within the tank.

9. A scissor jet cleaning device as recited in claim 8, wherein said thrust bearing is mounted offset from the center in said dome cover plate, to allow said support arm to bypass a valve stem and blow leg inside the tank of the tanker.

10. A scissor jet cleaning device as recited in claim 9, wherein said reversible motor is a hydraulic operated type motor.

11. A scissor jet cleaning device as recited in claim 9, wherein said reversible motor is an electrical operated type motor.

12. A scissor jet cleaning device as recited in claim 1, wherein said extending and retracting means includes:

a) a dome cover plate;

b) means for fastening said dome cover plate to the dome of the tank;

c) a reversible motor positioned over said dome cover plate;

d) a cylindrical casing having an elongated vertical slot, said cylindrical casing is affixed to said reversible motor and extends downwardly therefrom through said dome cover plate;

e) a left and right threaded worm drive shaft which extends downwardly in said cylindrical casing and driven by said reversible motor; and f) a pair of followers on a first side of said support arm that ride within the vertical slot in said cylindrical casing, said followers can be moved towards and away from each other depending upon direction of rotation by said left and right threaded worm drive shaft that engages with said followers.

13. A scissor jet cleaning device as recited in claim 12, wherein said fastening means includes a plurality of bolts which are radially threaded into said dome cover plate adjacent to and about the circumference of said dome cover plate and then into the dome of the tank.

14. A scissor jet cleaning device as recited in claim 12, further including a vent pipe extending through said dome cover plate, so as to vent out air from the interior of the tank.

15. A scissor jet cleaning device as recited in claim 13, wherein said rotating means includes:

a) a thrust bearing mounted through said dome cover plate, to allow a top portion of said cylindrical casing to rotate thereabout; and b) a handle pointer extending from one side of said reversible motor in the same direction as said support arm within the tank, so that a hand of a person can grip said handle pointer and move said reversible motor to properly position said support arm within the tank.

16. A scissor jet cleaning device as recited in claim 15, wherein said thrust bearing is mounted offset from the center in said dome cover plate, to allow said support arm to bypass a valve stem and blow leg inside the tank of the tanker.

17. A scissor jet cleaning device as recited in claim 12, wherein said reversible motor is a hydraulic operated type motor.

18. A scissor jet cleaning device as recited in claim 12, wherein said reversible motor is an electrical operated type motor.

19. A scissor jet cleaning device as recited in claim 1, wherein said fluidly connecting means includes;

a) a dome cover plate;

b) a first hose line extending between said double spray nozzle head and said dome cover plate; and c) a second hose line extending between the dome cover plate and a faucet on a container holding the pressurized cleaning fluid therein, so that when the faucet is opened, the pressurized cleaning fluid will flow out of the container to said double spray nozzle head.

* * * * *